US012773081B2

(12) United States Patent
Jung et al.

(10) Patent No.: US 12,773,081 B2
(45) Date of Patent: Oct. 27, 2026

(54) VACUUM CLEANER AND METHOD FOR CONTROLLING SAME

(71) Applicant: LG ELECTRONICS INC., Seoul (KR)

(72) Inventors: Han Su Jung, Seoul (KR); Seok Hee Cho, Seoul (KR); Soong Keun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 493 days.

(21) Appl. No.: 18/269,426

(22) PCT Filed: Dec. 24, 2021

(86) PCT No.: PCT/KR2021/019855
§ 371 (c)(1),
(2) Date: Jun. 23, 2023

(87) PCT Pub. No.: WO2022/139553
PCT Pub. Date: Jun. 30, 2022

(65) Prior Publication Data

US 2024/0049934 A1 Feb. 15, 2024

(30) Foreign Application Priority Data

Dec. 24, 2020 (KR) ..... 10-2020-0183510

(51) Int. Cl.
*A47L 9/28* (2006.01)

(52) U.S. Cl.
CPC ..... *A47L 9/2831* (2013.01); *A47L 9/2842* (2013.01); *A47L 9/2884* (2013.01); *A47L 9/2889* (2013.01); *A47L 9/2857* (2013.01)

(58) Field of Classification Search
CPC .... A47L 9/2831; A47L 9/2842; A47L 9/2884; A47L 9/2889; A47L 9/2857
USPC ..... 15/300.1
See application file for complete search history.

(56) References Cited

U.S. PATENT DOCUMENTS

2018/0235422 A1* 8/2018 Lee ..... A47L 9/2884
2018/0279847 A1* 10/2018 Park ..... A47L 9/2857
2018/0289229 A1 10/2018 Kim et al.
(Continued)

FOREIGN PATENT DOCUMENTS

JP 2006-136381 A 6/2006
JP 6314098 B2 4/2018
JP 2020-600 A 1/2020
(Continued)

*Primary Examiner* — Katina N. Henson
(74) *Attorney, Agent, or Firm* — Birch, Stewart, Kolasch & Birch, LLP

(57) ABSTRACT

Provided is a vacuum cleaner including a motor configured to generate a suction force, an inverter configured to convert a DC power of a DC terminal capacitor into an AC power to output to the motor, and a controller configured to apply a control signal of the inverter to drive the motor, in which the controller is further configured to detect an event while the motor is driving, and generate the control signal to generate operation noise of the motor corresponding to the detected event. According to example embodiments of the present specification, it is possible to provide information to a user without a separate element by controlling the driving pattern of the motor in the vacuum cleaner.

16 Claims, 12 Drawing Sheets

(56) References Cited

U.S. PATENT DOCUMENTS

2020/0337510 A1 10/2020 Lee et al.

FOREIGN PATENT DOCUMENTS

| | | | |
|---|---|---|---|
| KR | 97-68980 | A | 11/1997 |
| KR | 10-2010-0112749 | A | 10/2010 |
| KR | 10-2017-0041413 | A | 4/2017 |
| KR | 10-2018-0046259 | A | 5/2018 |
| WO | WO 2010/117133 | A2 | 10/2010 |

* cited by examiner

VACUUM CLEANER AND METHOD FOR CONTROLLING SAME

CROSS REFERENCE TO RELATED APPLICATIONS

This application is the National Phase of PCT International Application No. PCT/KR2021/019855 filed on Dec. 24, 2021, which claims priority to and the benefit of Korean Patent Application No. 10-2020-0183510 filed on Dec. 24, 2020, the disclosures of which are incorporated herein by reference in their entirety.

TECHNICAL FIELD

This disclosure relates to a vacuum cleaner and a control method thereof, and one particular implementation relates to a method for conveying information to a user while continuing to operate by controlling a motor that generates a suction force during operation of a vacuum cleaner and a vacuum cleaner using the same.

BACKGROUND ART

A vacuum cleaner uses the suction force generated by a motor mounted inside the body of the cleaner to suck in debris along with air, separate the debris from the sucked in air, and collect and dispose of it.

These vacuum cleaners are categorized into canister cleaners, upright cleaners, stick cleaners, handheld cleaners, and robot cleaners. In the case of a canister cleaner, a suction nozzle for suctioning dust is provided separately from the cleaner body, and the cleaner body and the suction nozzle are connected to each other by a connection device. In the case of an upright cleaner, a suction nozzle is rotatably connected to the cleaner body. In the case of a stick cleaner and a handheld cleaner, the user holds the cleaner body by hand. However, in the case of a stick cleaner, the motor is placed close to the suction nozzle (lower center), and in the case of a handheld cleaner, the motor is placed close to the gripping part (upper center). Robot cleaners use autonomous driving systems to drive themselves around and clean themselves. These cleaners commonly generate noise due to the motor driving during operation, and the user's eyes are focused on the area to be cleaned rather than the cleaner itself when a user uses the cleaner to perform cleaning. Thus, it is difficult to provide the user with information related to the cleaner through auditory or visual methods.

Prior art: Korean Patent Laid-Open Publication No. 10-2018-0046259

The prior art relates to a haptic device that outputs vibrations that match the movement of a vacuum cleaner to a user, and discloses features that can effectively provide information to a user by outputting information related to the operation of the vacuum cleaner through vibrations.

However, the prior art has a disadvantage that the production cost of the cleaner may increase because the vacuum cleaner must be equipped with a separate motor for generating vibration, and the power consumption increases because the vibration generating motor must be driven to provide information to the user. To address these problems, there is a need for a method that can effectively provide information related to a vacuum cleaner to a user without requiring additional configuration of the vacuum cleaner.

DISCLOSURE OF INVENTION

Technical Goals

An aspect provides a control method of a motor for effectively providing information related to the operation of a vacuum cleaner and a vacuum cleaner using the control method.

Another aspect provides a control method for generating an operation sound recognizable to a user while maintaining a suction force of the motor during cleaning to enable the user to identify status information of the vacuum cleaner, and a vacuum cleaner using the control method.

Yet another aspect provides a control method for generating an operation sound by controlling the driving method of the motor while maintaining the motor driving to provide a user with information that the battery needs to be charged when the charge level of the battery is below a preset value during the operation of the motor of the vacuum cleaner, and a vacuum cleaner using the control method.

Technical Solutions

According to an aspect, there is provided a vacuum cleaner including a motor configured to generate a suction force, an inverter configured to convert a DC power of a DC terminal capacitor into an AC power to output to the motor, and a controller configured to apply a control signal of the inverter to drive the motor. The controller may be further configured to detect an event while the motor is driving, and generate the control signal to generate operation noise of the motor corresponding to the detected event.

According to another aspect, there is also provided a control method of a vacuum cleaner, the method including driving a motor configured to generate a suction force, determining whether an event is detected, and controlling the motor to generate operation noise of the motor corresponding to the detected event.

Effects

According to example embodiments of the present disclosure, by controlling the driving pattern of a motor in a vacuum cleaner, a user may be provided with information without separate element.

Furthermore, according to example embodiments of the present disclosure, a user may be effectively provided with information about the status of the vacuum cleaner by generating operation noise by controlling the driving pattern of the motor while maintaining the suction force of the motor during the operation of the vacuum cleaner.

In addition, according to example embodiments of the present disclosure, by providing one or more operation noise patterns, a user may be effectively provided with various information during operation of the vacuum cleaner depending on situations.

BEST MODE FOR CARRYING OUT THE INVENTION

Figure 1A:
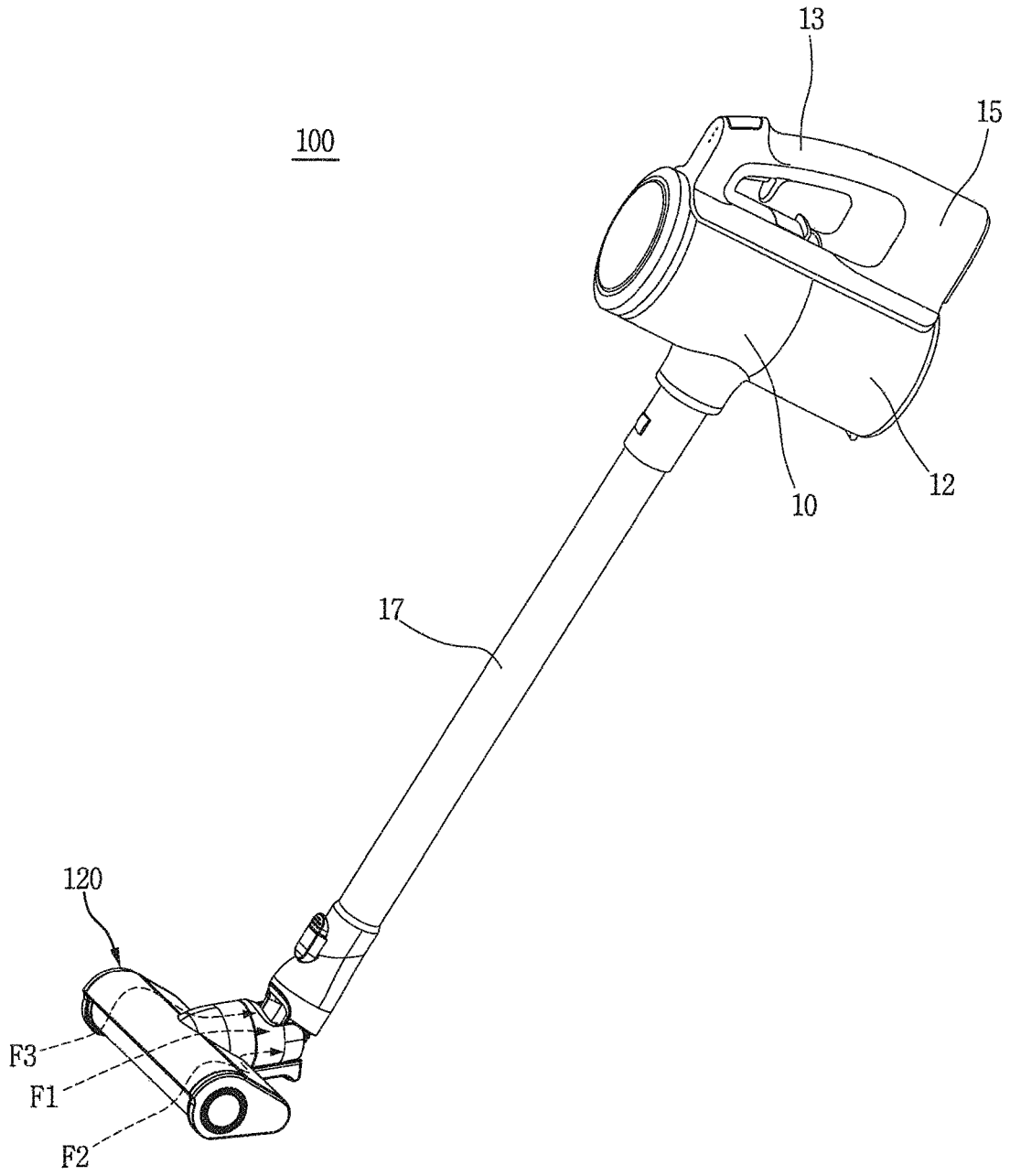
FIGS. 1A, 1B, 2A, and 2B are perspective views illustrating a vacuum cleaner and a battery assembly coupled to and powering the vacuum cleaner according to an example embodiment of the present disclosure.

Embodiments of the disclosure will be described herein below with reference to the accompanying drawings. However, the embodiments of the disclosure are not limited to the specific embodiments and should be construed as including all modifications, changes, equivalent devices and methods, and/or alternative embodiments of the present disclosure. In the description of the drawings, similar reference numerals are used for similar elements.

The terms "have," "may have," "include," and "may include" as used herein indicate the presence of corresponding features (for example, elements such as numerical values, functions, operations, or parts), and do not preclude the presence of additional features.

The terms "A or B," "at least one of A or/and B," or "one or more of A or/and B" as used herein include all possible combinations of items enumerated with them. For example, "A or B," "at least one of A and B," or "at least one of A or B" means (1) including at least one A, (2) including at least one B, or (3) including both at least one A and at least one B.

The terms such as "first" and "second" as used herein may use corresponding components regardless of importance or an order and are used to distinguish a component from another without limiting the components. These terms may be used for the purpose of distinguishing one element from another element. For example, a first user device and a second user device may indicate different user devices regardless of the order or importance. For example, a first element may be referred to as a second element without departing from the scope the disclosure, and similarly, a second element may be referred to as a first element.

It will be understood that, when an element (for example, a first element) is "(operatively or communicatively) coupled with/to" or "connected to" another element (for example, a second element), the element may be directly coupled with/to another element, and there may be an intervening element (for example, a third element) between the element and another element. To the contrary, it will be understood that, when an element (for example, a first element) is "directly coupled with/to" or "directly connected to" another element (for example, a second element), there is no intervening element (for example, a third element) between the element and another element.

The expression "configured to (or set to)" as used herein may be used interchangeably with "suitable for," "having the capacity to," "designed to," "adapted to," "made to," or "capable of" according to a context. The term "configured to (set to)" does not necessarily mean "specifically designed to" in a hardware level. Instead, the expression "apparatus configured to . . . " may mean that the apparatus is "capable of . . . " along with other devices or parts in a certain context. For example, "a processor configured to (set to) perform A, B, and C" may mean a dedicated processor (e.g., an embedded processor) for performing a corresponding operation, or a generic-purpose processor (e.g., a central processing unit (CPU) or an application processor (AP)) capable of performing a corresponding operation by executing one or more software programs stored in a memory device.

Exemplary embodiments of the present invention are described in detail with reference to the accompanying drawings.

Detailed descriptions of technical specifications well-known in the art and unrelated directly to the present invention may be omitted to avoid obscuring the subject matter of the present invention. This aims to omit unnecessary description so as to make clear the subject matter of the present invention.

For the same reason, some elements are exaggerated, omitted, or simplified in the drawings and, in practice, the elements may have sizes and/or shapes different from those shown in the drawings. Throughout the drawings, the same or equivalent parts are indicated by the same reference numbers Advantages and features of the present invention and methods of accomplishing the same may be understood more readily by reference to the following detailed description of exemplary embodiments and the accompanying drawings. The present invention may, however, be embodied in many different forms and should not be construed as being limited to the exemplary embodiments set forth herein. Rather, these exemplary embodiments are provided so that this disclosure will be thorough and complete and will fully convey the concept of the invention to those skilled in the art, and the present invention will only be defined by the appended claims. Like reference numerals refer to like elements throughout the specification.

It will be understood that each block of the flowcharts and/or block diagrams, and combinations of blocks in the flowcharts and/or block diagrams, can be implemented by computer program instructions. These computer program instructions may be provided to a processor of a general-purpose computer, special purpose computer, or other programmable data processing apparatus, such that the instructions which are executed via the processor of the computer or other programmable data processing apparatus create means for implementing the functions/acts specified in the flowcharts and/or block diagrams. These computer program instructions may also be stored in a non-transitory computer-readable memory that can direct a computer or other programmable data processing apparatus to function in a particular manner, such that the instructions stored in the non-transitory computer-readable memory produce articles of manufacture embedding instruction means which implement the function/act specified in the flowcharts and/or block diagrams. The computer program instructions may also be loaded onto a computer or other programmable data processing apparatus to cause a series of operational steps to be performed on the computer or other programmable apparatus to produce a computer implemented process such that the instructions which are executed on the computer or other programmable apparatus provide steps for implementing the functions/acts specified in the flowcharts and/or block diagrams.

Furthermore, the respective block diagrams may illustrate parts of modules, segments, or codes including at least one or more executable instructions for performing specific logic function(s). Moreover, it should be noted that the functions of the blocks may be performed in a different order in several modifications. For example, two successive blocks may be performed substantially at the same time, or may be performed in reverse order according to their functions.

According to various embodiments of the present disclosure, the term "module", means, but is not limited to, a software or hardware component, such as a Field Programmable Gate Array (FPGA) or Application Specific Integrated Circuit (ASIC), which performs certain tasks. A module may advantageously be configured to reside on the addressable storage medium and be configured to be executed on one or more processors. Thus, a module may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The functionality provided for in the components and modules may be combined into fewer components and modules or further separated into additional components and modules. In addition, the components and modules may be implemented such that they execute one or more CPUs in a device or a secure multimedia card.

Figure 1B:
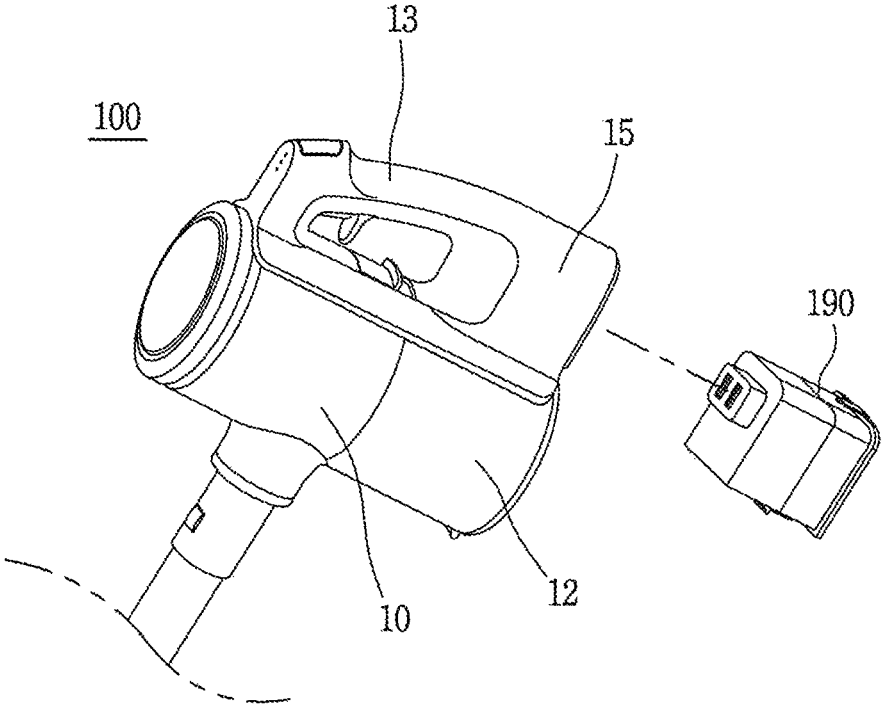

FIGS. 1A and 1B are perspective views illustrating a vacuum cleaner, for example, a stick cleaner, and a battery assembly coupled to and powering the stick cleaner, according to an example embodiment of the present disclosure.

Referring to FIG. 1A, a perspective view of a stick cleaner 100 is illustrated, and referring to FIG. 1B, a perspective view of a battery assembly 190 coupled to a body 10 of the stick cleaner 100 is illustrated.

The stick cleaner 100 may include the cleaner body 10 having a motor therein for generating a suction force, a suction part 120 for inhaling air containing dust, and an extension tube 17 connecting the cleaner body 10 and the suction part 120. In an example embodiment, the suction part 120 may be connected directly to the cleaner body 10 without the extension tube 17. Also, although not shown, the suction part 120 may be changed to an alternative suction part with a different shape depending on the suction function and connected to the cleaner body 10 or the extension tube 17. The suction part of an example embodiment may form a plurality of flow paths F1, F2, and F3, and cleaning may be accomplished by drawing air through these flow paths.

The cleaner body 10 may include a dust container 12 in which dust separated from the air is stored. Accordingly, dust entering through the suction part 20 may move to the body 10 via the extension tube 17, and dust filtered through a structure such as a filter may be stored in the dust container 12.

An outer side of the cleaner body 10 may be provided with a handle 13 for gripping by a user. The user may perform cleaning while gripping the handle 13, and near the handle 13, an input part for controlling the cleaner body 10 may be provided. Such an input part may receive a user input for powering on or off the cleaner body 10, for example. Also, the input part may receive a user input for adjusting a power level of the motor while the motor is driven according to cleaning. Further, the input part may receive a user input for setting or changing various predetermined cleaning operation modes.

The cleaner body 10 may be equipped with a battery assembly including a rechargeable battery (not shown). For this purpose, the cleaner body 10 may be provided with a battery receptacle 15 in which the battery is received. For example, the battery receptacle 15 may be provided in a lower part of the handle 13.

The battery included in the battery assembly may be connected to the suction part 120 to provide power to the suction part 100. Additionally, the battery may power each of the electrical components of the cleaner 100, including the motor (not shown) built into the body 10 to generate suction force.

Meanwhile, the battery assembly 190 mounted in the battery receptacle 15 may be withdrawn toward the bottom surface of the battery receptacle 15, as shown in FIG. 1B. Thereby, the battery assembly 190 may be separated from the cleaner body. The battery assembly 190 may be separated from the cleaner body by user operation when the battery requires recharging. Additionally, the battery may be charged via a power source supplied through the body, while the battery assembly 190 is connected to the body 10, or directly connected to the battery assembly 190.

In this case, if the battery level is below a preset value, the battery may need to be charged to operate the cleaner. Upon detecting that the battery needs to be charged, the cleaner may provide information to the user, and if the motor is running while the cleaner is in operation, this information may be provided by adjusting the noise pattern of the motor operation.

Figure 2A:
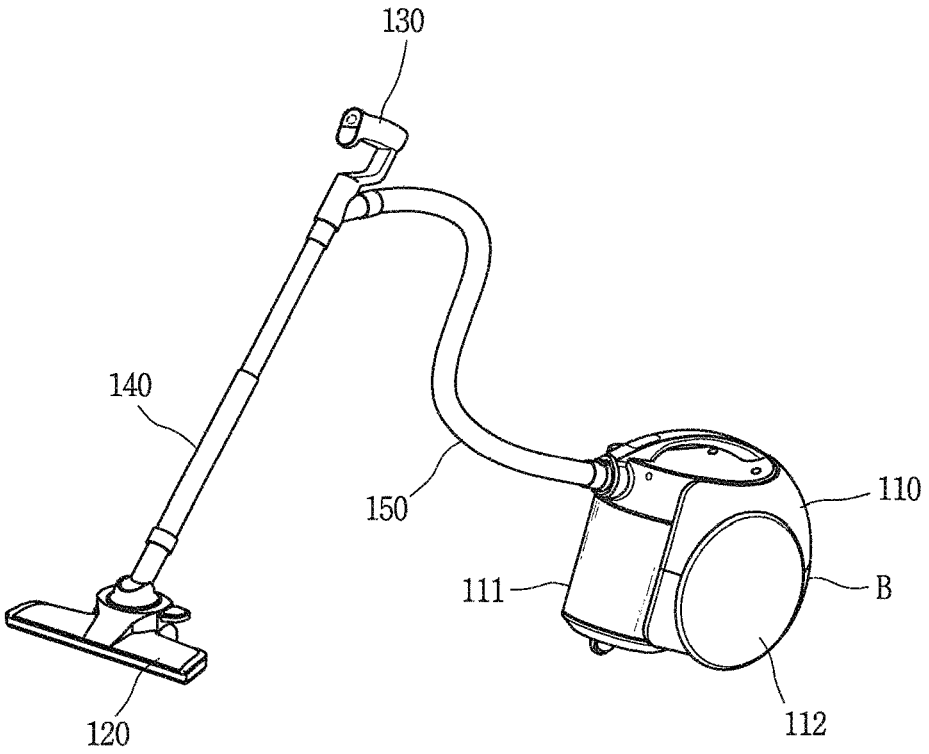
Figure 2B:
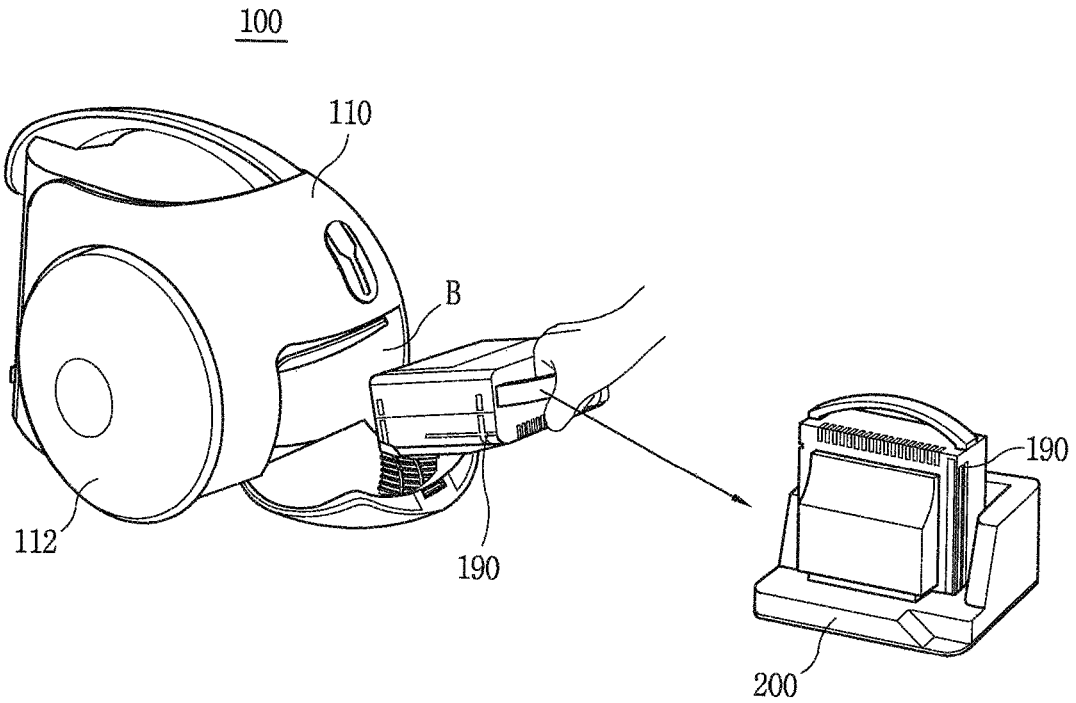

FIGS. 2A and 2B are perspective views illustrating another vacuum cleaner, for example, a canister cleaner, and a battery assembly coupled to and powering the canister cleaner, according to an example embodiment of the present disclosure.

Referring to FIG. 2A, a perspective view of the canister cleaner is illustrated, and referring to FIG. 2B, a perspective view of a battery assembly 190 coupled to a body 110 of the canister cleaner is illustrated.

The vacuum cleaner of the example embodiment may have a suction part 120 and an extension tube 140 connected to the cleaner body 110 via a flexible hose 150. In other words, the cleaner body 110 and the suction part 120 may be separated, and a user may operate the direction of movement of the suction part 120 while gripping a handle 130. The cleaner body separated from the suction part 120 moves by traveling/rotating the traveling parts 111 and 112 in the direction in which the flexible hose 150 is pulled according to the user's operation of the handle 130. A rear portion of the cleaner body 110 may be provided with a battery receptacle B in which a battery assembly is mounted Referring to FIG. 2B, a door may be provided on the exterior side of the battery receptacle B. When the door is opened in response to a user operation, the battery receptacle B is exposed. Into the exposed battery receptacle B, a battery assembly 190 may be inserted or withdrawn. When the battery assembly 190 is withdrawn from the battery receptacle B, the battery may be said to be disconnected from the cleaner body 110.

The battery assembly 190 may be withdrawn from the battery receptacle B by a user operation when the battery requires charging, and in some example embodiments, charging may be performed while the battery assembly 190 is still coupled to the body 110.

In this case, if the battery level is below a preset value, the battery may need to be charged to operate the cleaner. Upon detecting that the battery needs to be charged, the cleaner may provide information to the user, and if the motor is running while the cleaner is in operation, this information may be provided by adjusting the noise pattern of the motor operation.

Figure 3A:
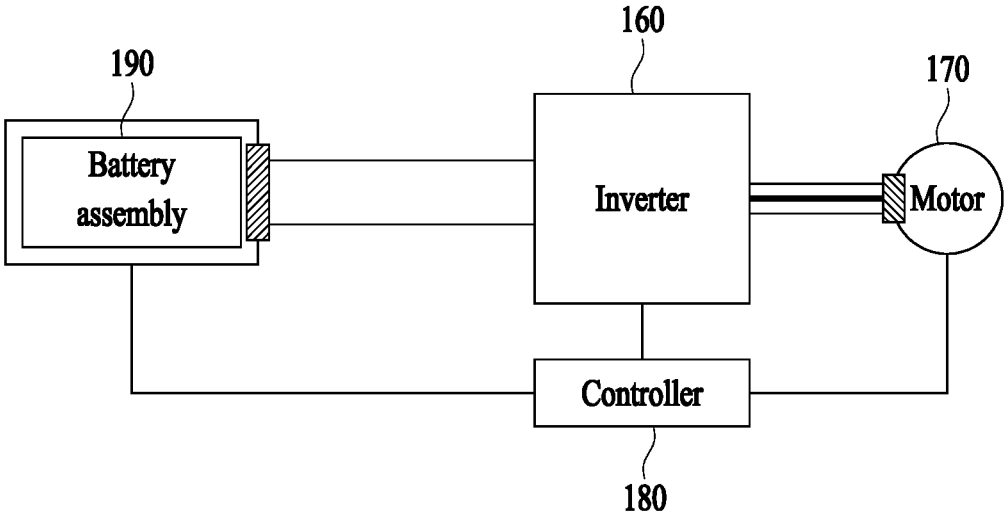
FIGS. 3A and 3B are block diagram and circuit diagram, respectively, of a drive circuit in a vacuum cleaner according to an example embodiment of the present disclosure in which a motor is driven by a battery voltage or a voltage charged to a capacitor.

FIG. 3A is a block diagram illustrating how a supply voltage provided from a battery in a battery assembly mounted on a cleaner passes through an inverter circuit 160 to a motor 170, such as a brushless DC electric motor (BLDC) motor. The BLDC motor disclosed herein may be understood as the motor 170. However, it is not intended that the motor 170 according to the present disclosure is necessarily limited to a BLDC motor, and without being inconsistent with the present disclosure, the motor 170 may be interpreted to include a brush-type motor. Meanwhile, in example embodiments, the motor 170 may generate noise by varying its rotational speed while maintaining the suction force within a certain range under the control of a controller.

Since the BLDC motor has no brushes, the motor rotates by magnetizing (energizing) each of the three phases u, v, and w to form a magnetic field. In addition, the BLDC motor has a stator made of a coil and a rotor made of a permanent magnet in the center. The rotational speed of the BLDC motor may be obtained by detecting the position of the rotor. In an example embodiment, the initial operation may be performed by estimating the position of the rotor or aligning the position of the rotor.

The battery assembly 190 includes the battery that supplies voltage to the motor when the cleaner is in operation. The battery assembly 190 may further include battery management system (BMS) circuitry for stabilizing and balancing the battery comprising a plurality of cells.

Under the control of the BMS, the voltage charged to the battery is provided to an input terminal of the inverter switch 160 via a power line, as a supply voltage. The supply voltage may have a magnitude of, for example, 25 volts (V), and may have a magnitude of up to 30V (or, 29.4V). In an example embodiment, the supply voltage may vary depending on the specification of the cleaner, and the operation of the cleaner throughout the described example embodiments may be applicable regardless of the supply voltage of the battery.

The power line may be connected to a voltage detection means, such as a voltage sensor, for detecting the magnitude of the supply voltage. In another example, a voltage sensor may be connected to an output terminal of the inverter 160 to detect the supply voltage being applied to the motor 170. Meanwhile, in an example embodiment, the controller may determine the battery level based on the magnitude of the supply voltage. If the supply voltage falls below a preset range, the battery level may be determined to have fallen correspondingly, and the controller may control the operation of the cleaner based on the battery output voltage. In an example embodiment, when the battery level is detected to have dropped below a certain value for the operation of the cleaner, an operation may be performed to notify the user.

The inverter 160 may provide the motor 170 with the supply voltage provided by the battery in the battery assembly 190. The inverter 160 may be implemented as a three-phase inverter, such that the supply voltage may be provided to each of the three phases of the BLDC motor. The inverter 160 may provide any desired form of voltage to the BLDC motor through switching of the controller.

The controller 180 may control the operation of the battery assembly 190, the inverter 160, and the motor 170, and may output control signals for this purpose. Further, in the present disclosure, the controller 180 may include switch control means or a pulse-width modulation (PWM) module, and may input switching signals to the inverter 160 to regulate the power supplied to the motor 170.

In such a case, the controller 180 may output a PWM signal to the inverter 160, or alternatively, a gate signal to a MOSFET (not shown) connected to the inverter 160 for this purpose.

In normal operation of the cleaner, the supply voltage provided by the battery of the battery assembly 190 may be controlled such that the rotational speed of the motor reaches a target rotational speed, and the rotational speed of the motor may be regulated in response to a command signal from the controller 180.

Specifically, when the PWM signal output by the controller 180 is delivered to the inverter 160 or the gate of MOSFET (not shown) connected to the inverter, the power supplied to each phase of the motor may be changed. In this case, as the percentage of on duty of the PWM signal increases, the amount of power W applied to the BLDC motor increases correspondingly. Now, when the rotational speed of the motor reaches the target rotational speed, the motor control may be performed so that the speed of the motor does not increase any more. For example, the controller 180 may decrease the duty cycle of the PWM signal to correspondingly decrease the amount of power W applied to the BLDC motor. This process may be applied in various ways during the operation of the cleaner. In addition, under the control of the controller 180, the control signals for rotating the motor may take on a particular pattern, and may produce a sound that is perceptible to a user as the motor rotating while minimizing the reduction in the average number of revolutions. This allows information to be conveyed to the user in certain situations through a recognizable noise generated by the motor rotation. For example, when the battery level is below a certain amount and the cleaner is running, the control signal controlling the motor may be changed to a specific pattern to generate noise through motor rotation, and the user may check the status information of the cleaner through the noise even while the cleaner is continuing the suction action.

On the other hand, if the battery assembly 190 is disconnected from the cleaner body during the above operation of the cleaner, the duty cycle of the PWM signal may be adjusted differently in response to a change in the magnitude of the supply voltage due to the disconnection of the battery assembly 190 and a change in the rotational speed of the suction motor.

Figure 3B:
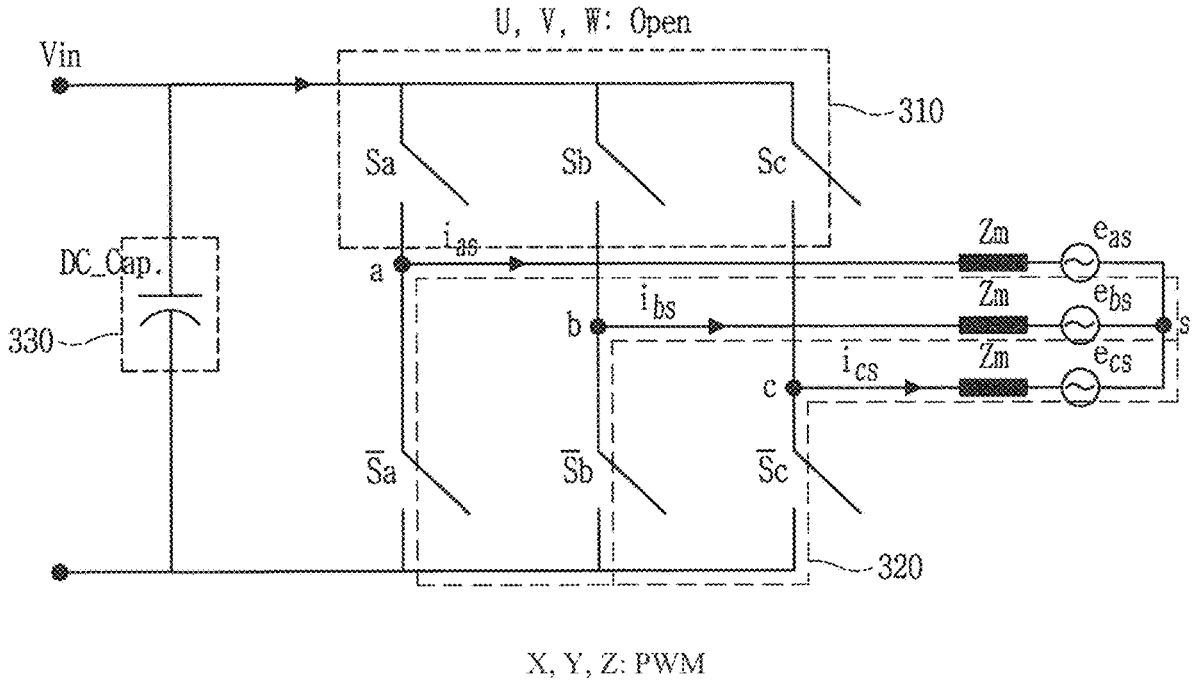

As shown in FIG. 3B, the inverter circuit comprises a three-phase inverter having three pairs of upper and lower switching elements 310 and 320 and a DC terminal capacitor 330 from which the supply voltage is smoothed and charged. The three pairs of upper and lower switching elements 310 and 320 may be implemented using at least one of an insulated gate bipolar transistor (iGBT), a MOSFET, and a bipolar junction transistor (BJT).

In the illustrated inverter circuit, the supply voltage provided through the DC terminal capacitor 330 is provided to the BLDC motor via the upper switching element 310 and the lower switching element 320. At this time, a PWM signal corresponding to a duty cycle that is preset or calculated based on the rotational speed of the motor is output to the upper and lower switching elements 310 and 320, so that the upper and lower switching elements 310 and 320 are switched on and off at a high speed.

On the other hand, when the battery assembly 190 is disconnected from the cleaner body during the operation of the cleaner, the upper switching elements 310 of the inverter circuit are all turned off and are in an off state. The lower switching element 320 is not turned off, but is PWM controlled with a set duty cycle within a range of about 1% of the supply voltage.

For example, if the supply voltage of the battery is 25V, then the lower switching element 320 is controlled on and off with a duty cycle of 1% compared to 25V after the battery is disconnected. Also, for example, if the supply voltage of the battery is 30V, the lower switching element 320 is controlled on and off with a duty cycle of 1% compared to 30V after the battery is disconnected.

Thus, a duty cycle of the PWM signal output to the lower switching element 320 of about 1% means that the PWM signal is output in an amount that is smaller than the duty cycle of the PWM signal that was output to the lower switching element 320 in a normal state. Therefore, it does not necessarily mean that the duty cycle of the PWM output to the lower switching element 320 is limited to 1%.

Once the battery assembly is disconnected from the cleaner body, the controller 180 may output a first control signal/first gate signal to the upper switching element 310 of the inverter circuit to switch to the off state, and the lower switching element 320 outputs a second control signal/second gate signal to perform PWM control with a reduced amount of duty cycle. The upper switching element 310 includes switches Sa, Sb and Sc, and the lower switching element 320 includes switches $\overline{S}_a$, $\overline{S}_b$, $\overline{S}_c$.

Furthermore, the duty cycle of the PWM signal output to the lower switching element 320 of about 1% means that the PWM signal is output with a duty cycle of a fixed range/fixed value, rather than the amount of the duty cycle being adjusted according to the magnitude of the input voltage.

Thus, the amount of the duty cycle does not vary with the magnitude of the supply voltage, and the PWM signal is output to the lower switching element 320 in the inverter circuit with a duty cycle of a fixed range/fixed value, such as a duty cycle that is reduced to about 1%.

As such, when the controller 180 of the cleaner detects that the battery assembly 190 has been disconnected from the cleaner body, it adjusts the duty cycle of the PWM signal to the lower switching element in the inverter circuit to a smaller amount than before the battery assembly 190 was disconnected.

For example, if the duty cycle performed prior to the disconnection of the battery assembly 190 is 10%, then after the disconnection of the battery assembly 190, the PWM signal is output with a duty cycle of 1%, which is reduced to about 1/10. Also, if a PWM signal is output with a duty cycle of 15% in a normal state, the PWM signal is output with a duty cycle of 1.5% after disconnecting the battery assembly 190, which is reduced to about 1/10.

In this way, after disconnecting the battery, phase currents ias, ibs, and ics are supplied to the motor through PWM control for the lower switching element 320 of the inverter circuit, and are magnetized from the DC terminal capacitor 330 side to the motor side without overvoltage due to reverse electromotive force.

As shown above, according to the present disclosure, when the battery is disconnected during the operation of the cleaner, the PWM duty cycle is controlled to a predetermined value relative to the input voltage only for the lower switching element of the inverter. Thus, it is possible to economically prevent the burnout of parts of the inverter due to the generation of overvoltage by the reverse electromotive force generated by the motor.

Meanwhile, when the battery is operating normally, the controller may control the inverter switching to ensure that the motor operates in the desired manner.

Figure 4:
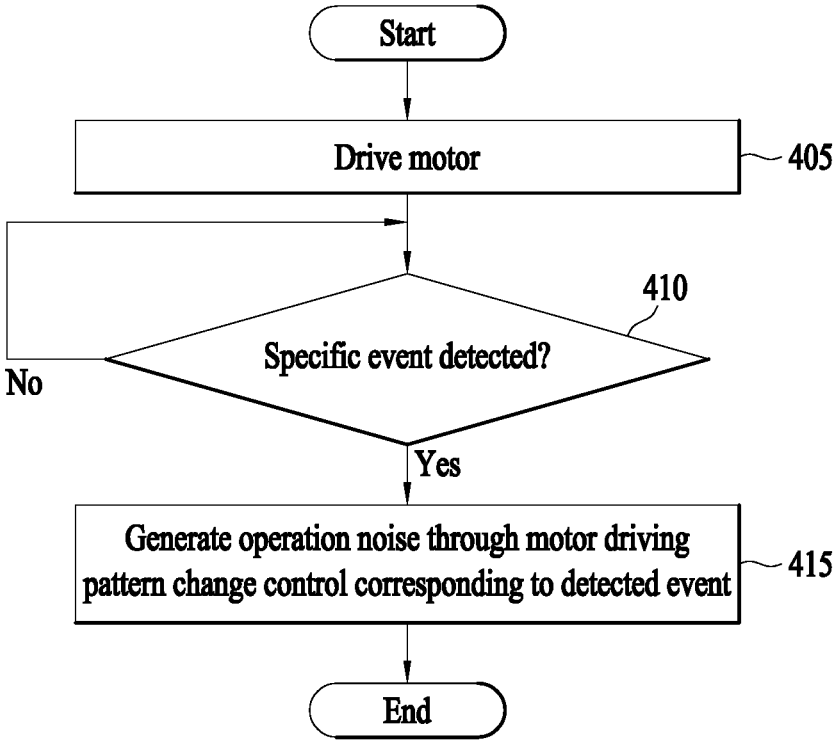
FIG. 4 is a flowchart illustrating a method for providing information through driving pattern control of a motor according to an example embodiment of the present disclosure.

FIG. 4 is a flowchart illustrating a method for providing information through driving pattern control of a motor according to an example embodiment of the present disclosure.

Referring now to FIG. 4, a method of controlling a motor driving pattern of a cleaner according to an example embodiment of the disclosure is shown.

In operation 405, the controller may perform motor driving of the cleaner. This motor driving may generate a suction force, which may be used to perform cleaning.

In an example embodiment, the controller may change the motor driving pattern to adjust the suction force based on the cleaning environment or user input. For example, the controller may control the motor to increase the rotational speed of the motor or increase the torque of the motor when a high suction force is required.

In operation 410, the controller may check if a specific event is detected while performing the motor driving. In example embodiments, the specific event may be an event associated with the driving of the cleaner, and may be set by a user or programmed into the controller. In one example, the specific event may be a case where the battery level is less than or equal to a specific value. In another example, the specific event may be detection of a blockage in the cleaner inlet. If no event is detected, the motor may continue to run.

In operation 415, the controller may perform driving pattern change control of the motor corresponding to the detected event to drive the motor. In an example embodiment, the controller may perform a driving pattern change of the motor corresponding to the detected event while maintaining at least one of the driving speed and the driving torque of the motor within a certain range. In one example, the motor operation noise may be generated by performing the driving pattern change of the motor while maintaining at least one of the motor driving speed and the motor driving torque within a similar range prior to the event detection. In one example, the operation noise may be generated while maintaining at least 90% of the at least one of the driving speed and driving torque. Generating the operation noise in this way may be accomplished by changing the pattern of the inverter control signal for driving the motor to generate the noise through an instantaneous increase or decrease in the motor speed. In addition, in example embodiments, the controller may perform motor control in a different pattern for each detected event, so that a user may detect the corresponding event by recognizing a different noise. For example, the changes in motor driving patterns may be different when the battery level is below a certain value and when the cleaner inlet is blocked, and may generate different operation noises, thereby allowing the user to recognize the corresponding event based on the operation noise pattern. In an example embodiment, the operation noise may be expressed in the form of vibrations, and the user may detect such vibrations to recognize the corresponding event. In an example embodiment, the inverter may be controlled to perform switching to control the motor driving for a short period of time repeatedly, which may cause at least one of vibration and noise to be generated, and the user may recognize the event by detecting them.

In this way, the user may be informed of a corresponding event through a driving pattern change of the motor while maintaining at least some of the driving speed and torque of the motor within a certain range, so that information may be provided to the user through the driving pattern change of the motor without a separate notification device even during cleaning. In one example, the specific range may be 90%, and according to an event occurrence, information may be provided to the user through the driving pattern change while maintaining a speed of 90% or more of the existing driving speed. The information may also be provided to the user through the driving pattern change according to the event occurrence while maintaining a torque of at least 90% of the existing driving torque.

This method of providing information has the effect of conveying information recognizable to the user even as the cleaning continues by changing the driving pattern to output a different type of noise or vibration in a situation where the default motion of the cleaner motor is loud.

Figure 5:
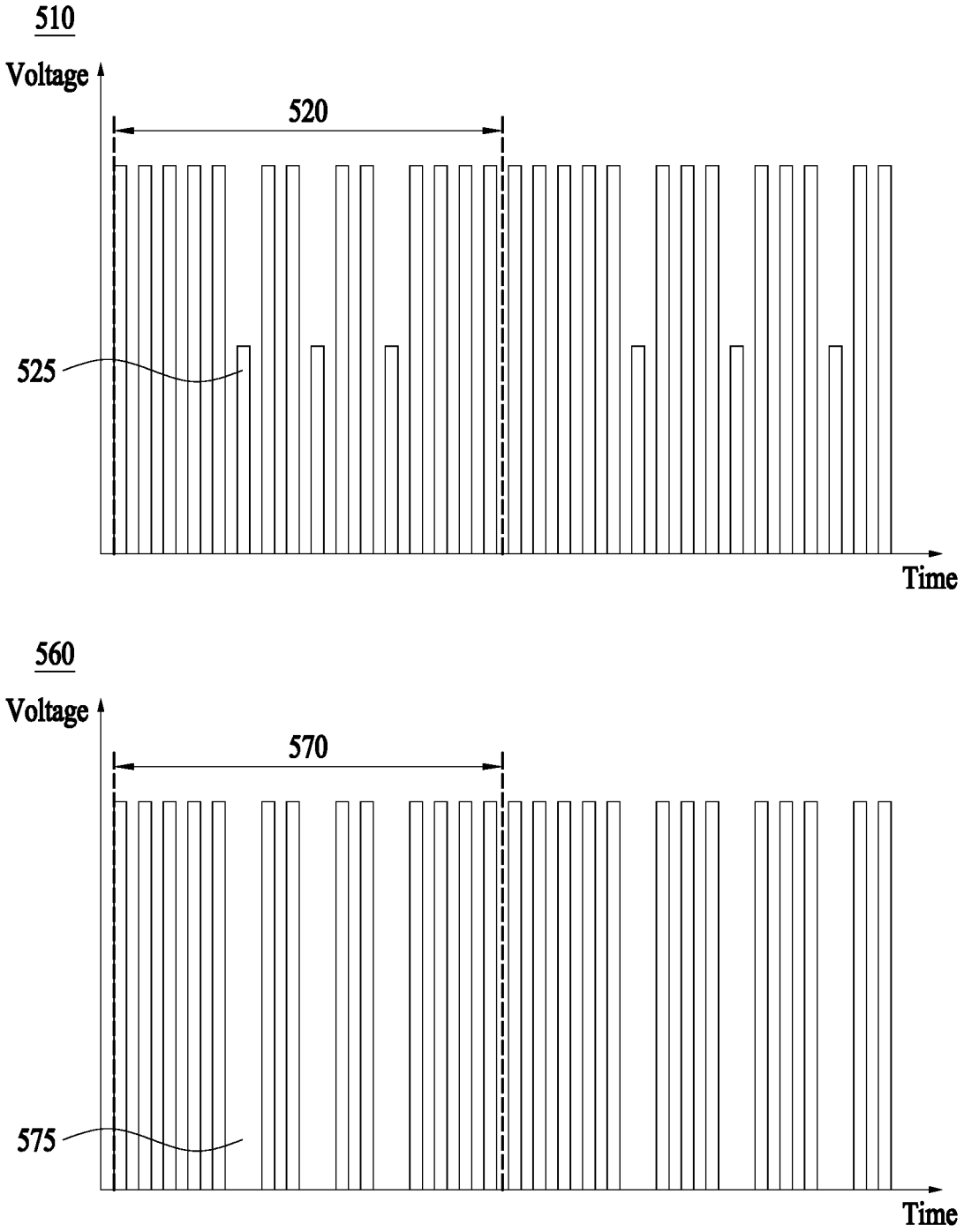
FIG. 5 is a diagram illustrating a waveform of a motor control signal for driving pattern control of a motor according to an example embodiment of the present disclosure.

FIG. 5 is a diagram illustrating a waveform of a motor control signal for driving pattern control of a motor according to an example embodiment of the present disclosure.

Referring to FIG. 5, a control signal controlling motor driving according to an example embodiment is illustrated. In the example embodiment, there are an interval in which the control signal corresponds to a high value and an interval in which the control signal corresponds to a low value, and the control signal may have a value between the high and low values in some intervals. In the example embodiment, for ease of description, the value between the high and low values is described as middle. The ratio at which the control signal corresponds to high may be referred to as a duty ratio, and as the duty ratio approaches 1, at least one of the driving speed and torque of the motor may increase.

Reference numeral 510 shows a first example embodiment of changing a control signal for motor driving in a situation where a specific event is detected in a motor operation interval corresponding to a duty ratio of 0.5. In the example embodiment, the controller may change at least one control signal corresponding to on duty in a particular interval 520 to middle 525. The controller may select the control signals that are changed to middle in response to an event, and may change no more than 20% of the existing signals corresponding to on duty to middle in a particular interval. Furthermore, the timing of the control signals that change to middle may be changed according to a pattern corresponding to the detected event. Further, at least one interval may be maintained to include control signals that are changed to middle, such as the particular interval 520. By changing the control signal to middle in this manner, the control signal changed to middle may change the pattern of motor driving, which may result in a different operation noise or vibration, while maintaining at least one of the existing rotational speed and torque, to provide the user with an indication of the occurrence of an event through the motor operation. In an example embodiment, the middle value may be 70% or less of the high value. Also, in an example embodiment, an interval in which the middle value or the low value is output may be located between intervals in which the high value is repeatedly output, and the intervals in which the middle value or the low value is output may be staggered by two or more times.

Reference numeral 560 shows a second embodiment of changing a control signal for motor driving in a situation where a specific event is detected in a motor operation interval corresponding to a duty ratio of 0.5. In the example embodiment, the controller may change at least one control signal corresponding to on duty in a particular interval 570 to low 575. The controller may select the control signals that are changed to low in response to an event, and may change no more than 20% of the existing signals corresponding to on duty to low in a particular interval. Furthermore, the timing of the control signals that change to low may be changed according to a pattern corresponding to the detected event. By changing the control signals to low in this manner, the control signal changed to low may change the pattern of motor driving, which may result in a different operation noise or vibration, while maintaining at least one of the existing rotational speed and torque, to provide the user with an indication of the occurrence of the event through the motor operation.

In addition, depending on example embodiments, the controller may change the signal corresponding to on duty in at least one of the specific intervals 520 and 570 to one of middle and low. Furthermore, which signal to change to middle or low may vary depending on the corresponding motor driving pattern. By controlling the motor operation in these different patterns, various forms of operation noise and vibration may be generated, which may provide the user with various information.

Figure 6:
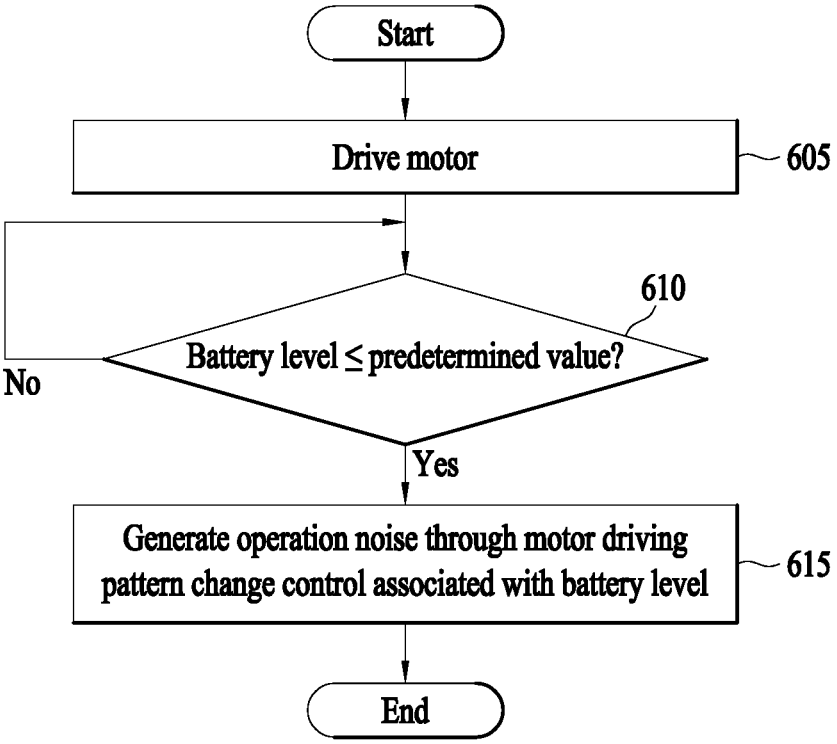
FIG. 6 is a flowchart illustrating a method for providing relevant information through driving pattern control of a motor based on a battery level according to an example embodiment of the present disclosure.

FIG. 6 is a flowchart illustrating a method for providing relevant information through driving pattern control of a motor based on a battery level according to an example embodiment of the present disclosure.

Referring to FIG. 6, a method of controlling a motor driving pattern according to a battery level of a cleaner according to an example embodiment of the present disclosure is shown.

In operation 605, the controller may perform motor driving of the cleaner. This motor driving may generate a suction force, which may be used to perform cleaning. In an example embodiment, the controller may change the motor driving pattern to adjust the suction force based on the cleaning environment or user input. For example, the controller may control the motor to increase the rotational speed of the motor or increase the torque of the motor when a high suction force is required. Such motor driving may be performed during the normal cleaning phase.

In operation 610, the controller may monitor whether the battery level is less than or equal to a predetermined value while performing motor driving. The controller may check the battery level based on at least one of information received from a BMS, an output voltage of the battery, and an output voltage of a DC capacitor connected in parallel with the battery, and in an example embodiment, the predetermined value may be selected based on an operable time of the motor. Depending on the control method of the currently operating motor, the predetermined value of the battery level may be set to a predetermined value corresponding to an operable time of 5 minutes or less. If the battery value is greater than the predetermined value, motor driving may be performed continuously.

If it is less than or equal to the predetermined value, an operation noise may be generated by the motor driving pattern change control associated with the battery level in operation 615. The controller may also generate an operation vibration by the driving pattern change control of the motor. In an example embodiment, the controller may perform the driving pattern change of the motor corresponding to a detected event while maintaining at least one of the driving speed and the driving torque of the motor within a certain range. In one example, the motor operation noise may be generated by performing the motor driving pattern change while maintaining at least one of the motor driving speed and the motor driving torque within a similar range prior to the event detection. In one example, the operation noise may be generated while maintaining at least 90% of the at least one of the driving speed and driving torque. Generating the operation noise in this way may be accomplished by changing the pattern of the inverter control signal for driving the motor to generate the noise through an instantaneous increase or decrease in the motor speed. In addition, in example embodiments, the controller may perform motor control in a different pattern for each detected event, so that a user may detect the corresponding event by recognizing a different noise. For example, the changes in motor driving patterns may be different when the battery level is below a certain value and when the cleaner inlet is blocked, and may generate different operation noises, thereby allowing the user to recognize the corresponding event based on the operation noise pattern. In an example embodiment, the operation noise may be expressed in the form of vibrations, and the user may detect such vibrations to recognize the corresponding event. In an example embodiment, the inverter may be controlled to perform switching to control the motor driving for a short period of time repeatedly, which may cause at least one of vibration and noise to be generated, and the user may obtain information about the battery level by detecting them.

Furthermore, in an example embodiment, the motor control may be performed such that the predetermined value is organized into a plurality of sets as the battery level decreases and the noise and vibration may be output in a corresponding pattern whenever the battery level corresponding to the set is detected. Thus, the user may be continuously informed through the control of the motor driving pattern to prevent a situation where the battery level decreases and the motor can no longer be driven. In such a case, the controller may control the motor to generate a motor operation noise according to the first pattern when the battery level is a first value, and a motor operation noise according to the second pattern when the battery level is a second value less than the first value. In this case, the motor operation noise generated according to the second pattern may be larger than the motor operation noise generated according to the first pattern. Also, the speed or torque of the motor when the motor is driven according to the second pattern may be less than the speed or torque of the motor when the motor is driven according to the first pattern. Also, the time during which the motor operation noise generated according to the second pattern is generated may be longer than the time during which the motor operation noise generated according to the first pattern is generated.

In this way, information about the battery level may be provided to the user by changing the driving pattern of the motor while maintaining at least some of the driving speed and torque of the motor within a certain range, so that the user may be provided with the information about the battery level through the driving pattern change of the motor without a separate notification device even during cleaning. This method of providing information has the effect of conveying information recognizable to the user even as the cleaning continues by changing the driving pattern to output a different type of noise or vibration in a situation where the default operation noise of the cleaner motor is loud.

Figure 7:
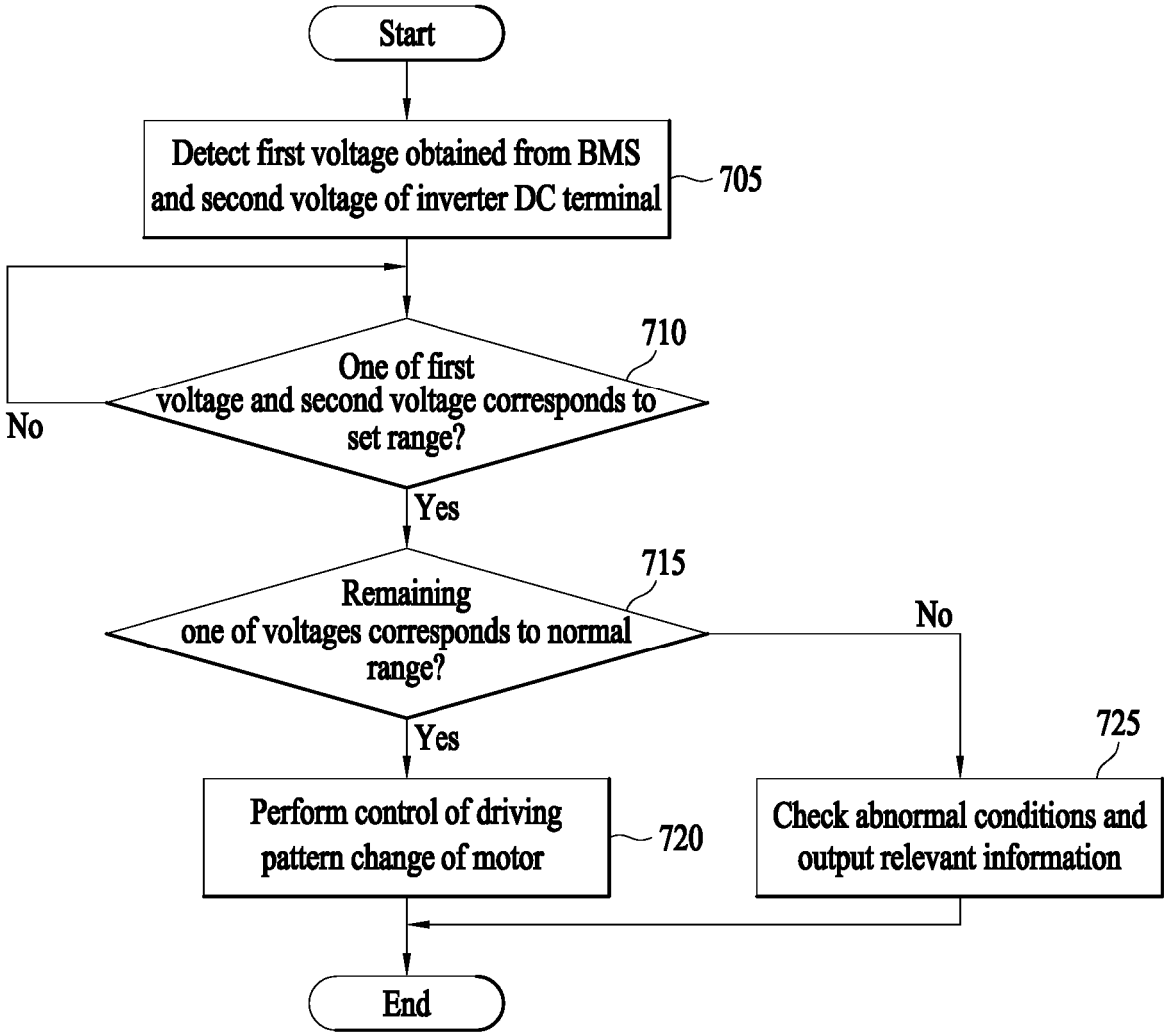
FIG. 7 is a flowchart illustrating a method for comparing BMS and battery output voltages to each other and providing relevant information through driving pattern control of a motor based thereon according to an example embodiment of the present disclosure.

FIG. 7 is a flowchart illustrating a method for comparing BMS and battery output voltages to each other and providing relevant information through driving pattern control of a motor based thereon according to an example embodiment of the present disclosure.

Referring to FIG. 7, an operation method of a controller for detecting an event associated with a battery level is illustrated.

In operation 705, the controller may obtain information about a first voltage, which is a battery output voltage, from the BMS, and may detect a second voltage, which is a voltage at the DC terminal of the inverter. In an example embodiment, the first voltage information may be information associated with a battery level provided by the BMS, and the controller may obtain the corresponding battery output voltage information and perform an operation corresponding to the example embodiment.

In operation 710, the controller may determine whether one of the first voltage and the second voltage corresponds to a set range. Depending on example embodiments, the first set range for determining the first voltage and the second set range for determining the second voltage may be the same or different, and each set range may be set to determine a battery level according to the corresponding voltage value. In one example, the first set range and the second set range may be set to a value corresponding to a battery level that may perform driving for 3 minutes in the normal cleaning mode. In addition, the set range may be set differently depending on the current operation mode of the motor. Based on the current operation mode of the motor, the set range may be determined based on a criterion that may further operate for a certain amount of time. Also, in an example embodiment, the first set range and the second set range may be values in the same range.

If the first and second voltages do not correspond to the set range, the monitoring may continue, and if one of the first and second voltages corresponds to the set range, the controller may determine if the other voltage corresponds to a normal range in operation 715. In example embodiments, the normal range may include the set range corresponding to that voltage. In example embodiments, if one of the voltages corresponds to the corresponding set range and the other voltage does not correspond to the corresponding set range, it may be determined that there is a failure in one of the functions of the battery level detection based on the BMS and the battery level detection based on the DC terminal output voltage.

Accordingly, if it corresponds to the normal range, control may be performed to change the driving pattern of the motor in response to the detected voltage according to operation 720. If it does not correspond to the normal range, the user may be informed that there is an error in at least one function of BMS or output voltage detection of the DC terminal. Furthermore, in an example embodiment, the controller may perform additional operations for detecting the abnormal condition to determine which function is abnormal, and may output the identified information to the user.

In addition, in an example embodiment, the process of conveying information by motor operation noise may be omitted when an abnormal condition is detected. In addition, it is possible to use the BMS voltage and the DC terminal voltage sensing value of the inverter complementarily, but considering the sensing error, to convey information through a change in the motor driving pattern when the two pieces of information correspond within the normal operating range.

On the other hand, if the values of the first voltage acquired through the BMS and the second voltage of the DC terminal of the inverter are outside the predetermined range, the abnormality of the sensor or controller that acquires each voltage value may be checked, relevant information may be provided to the user, and the driving pattern change control of the motor may be optionally performed. More specifically, if one sensor is confirmed to be normal, detection of whether to control the driving pattern of the motor may be performed based only on the value acquired through that sensor.

In this way, by checking the battery level through multiple measurement results and providing the user with information about it, the user may be provided with the relevant information effectively even if there is a problem with some of the functions.

Figure 8:
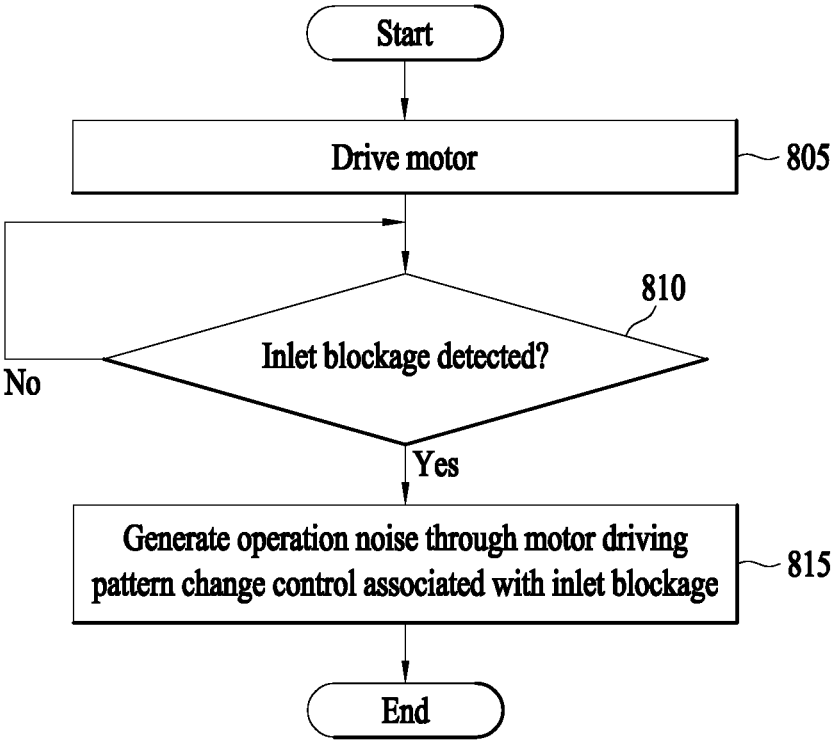
FIG. 8 is a flowchart illustrating a method for detecting an inlet blockage and providing relevant information accordingly through driving pattern control of a motor according to an example embodiment of the present disclosure.

FIG. 8 is a flowchart illustrating a method for detecting an inlet blockage and providing relevant information accordingly through driving pattern control of a motor according to an example embodiment of the present disclosure.

Referring to FIG. 8, a method of controlling a motor driving pattern in response to detecting an inlet blockage of a cleaner according to an example embodiment of the present disclosure is shown.

In operation 805, the controller may drive the motor. The motor driving may be performed in accordance with a user input, and cleaning may be performed by generating a suction force in accordance with the motor driving.

In operation 810, the controller may monitor whether an inlet blockage is detected during the motor driving. In an example embodiment, the controller may detect the inlet blockage by measuring a parameter associated with the motor driving. More specific detection methods will be described in other example embodiments. If the inlet blockage is not detected, the motor may be driven under user control while detecting whether the inlet is blocked.

In operation 815, if the controller detects the inlet blockage, the controller may generate an operation noise through by driving pattern change control of the motor according to the detected information. In an example embodiment, the generated operation noise may be an operation noise of a pattern corresponding to the inlet blockage, and the controller may generate such noise by changing a control signal for motor driving.

In this way, the controller may monitor parameters related to the driving of the motor to monitor whether an inlet blockage occurs, and if an inlet blockage is detected, the controller may change the driving pattern of the motor in response to the inlet blockage to generate the operation noise. This allows the user to be informed of the inlet blockage while continuously performing the motor driving.

Figure 9:
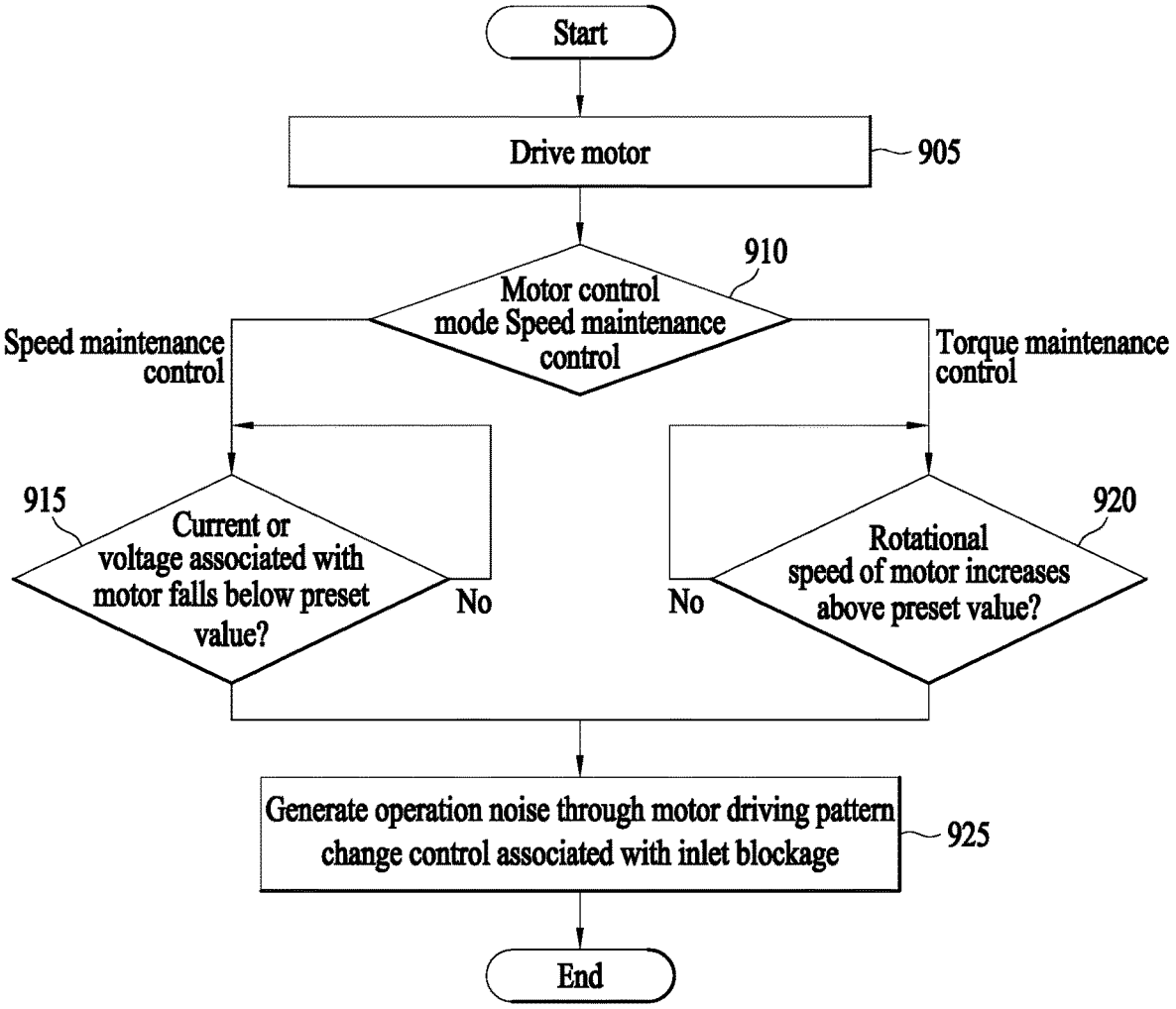
FIG. 9 is a flowchart illustrating a method for detecting an inlet blockage according to a control mode of a motor and providing information through driving pattern control of the motor according to an example embodiment of the present disclosure.

FIG. 9 is a flowchart illustrating a method for detecting an inlet blockage according to a control mode of a motor according to an example embodiment of the present disclosure and providing information thereon through driving pattern control of the motor.

Referring to FIG. 9, a method of detecting an inlet blockage in a manner corresponding to a control mode of a motor, and providing the information through driving pattern control of the motor, according to example embodiments of the present disclosure, is illustrated.

In operation 905, the controller may drive the motor. The motor driving may be performed in accordance with a user input, and cleaning may be performed by generating a suction force in accordance with the motor driving.

In operation 910, the controller may identify the control mode of the motor. In example embodiments, a method for adaptively detecting whether the inlet is blocked may be determined according to the control mode of the motor. The control mode of the motor may be determined based on at least one of a cleaning mode, a user control, and a cleaner status.

When performing speed maintenance control, the controller may check to see if the current or voltage associated with the motor falls below a preset value in operation 915. If the current or voltage value drops in the speed maintenance control, it may be determined to be an inlet blockage, and otherwise, at least one of the current and voltage of the motor may be continuously monitored. In an example embodiment, the preset value may be adaptively determined based on the current or voltage value prior to the event detection. The controller may detect the inlet blockage if the current or voltage value changes by more than a certain value from the value corresponding to the previous behavior, without any separate change in the control signal for controlling the motor.

When performing torque maintenance control, the controller may check to see if the motor speed increases above a preset value in operation 920. If the rotational speed of the motor increases above the preset value in torque maintenance control, it may be determined to be an inlet blockage, and otherwise, the motor's rotational speed may be continuously checked. In an example embodiment, the preset value may be adaptively determined based on the motor speed prior to the event detection. The controller may detect the inlet blockage if the motor speed value changes by more than a certain value from the value corresponding to the previous behavior, without any separate change in the control signal for controlling the motor.

If the inlet blockage is thus detected, in operation 925, the controller may generate an operation noise through driving pattern change control of the motor associated with the inlet blockage. In example embodiments, different patterns of control signals may be applied for the speed maintenance control and torque maintenance control, respectively, but are not limited thereto, and the same pattern of control signals may be applied. When control signals corresponding to different patterns are applied, at least one of the motor operation noise and vibration corresponding to the inlet blockage may be generated in each of the speed maintenance control and torque maintenance control. In this way, by detecting the inlet blockage in different ways depending on the control modes of the motor, it is possible to smoothly detect the inlet blockage in various environments, and user convenience may be improved by adaptively providing information about the inlet blockage to the user.

While references throughout the specification are made to the cleaner sucking dust along with air, it is not limited thereto, and the cleaner may be driven in such a way that the motor driving generates a suction force to suck other debris along with air.

Additionally, throughout example embodiments, when a certain event is detected, the motor driving pattern may be changed to produce a form of noise or vibration that corresponds to the event. More specifically, the driving pattern of the motor that generates the suction force may be changed to generate at least one of motor operation noise and vibration that may be perceived by a user while the motor is running to communicate information to the user.

With respect to the present example embodiment, a case where a motor is damaged may be distinguished from an operation pattern when a specific event occurs. It is because the motor cannot be driven when the motor is damaged, or the motor would be stopped by detecting a motor abnormality even if it is driven.

In addition, if the inverter is burned out, the motor cannot be controlled and the motor does not start, which can be distinguished from the operation pattern when a specific event occurs. However, if the DC terminal voltage detection part of the inverter is burned out, there is no problem with the operation of the inverter itself, so there is no problem with motor control, but the detected voltage value deviates from the normal range, which can confirm the burnout of the inverter. In addition, in the case of exceeding the voltage detection range or when the voltage is low enough to differ from the cut-off voltage, a protective operation is performed through internal low and high voltage detection, so that noise related to motor operation cannot be generated.

From the foregoing, it will be appreciated that various embodiments of the present disclosure have been described herein for purposes of illustration and that specific terms have been used, but are merely used in a general sense to easily explain the technical content of the present disclosure and to help easy understanding of the present disclosure and are not intended to limit the scope of the present disclosure. Those skilled in the art will appreciate that various other modifications based on the technical idea of the present disclosure are possible.

The invention claimed is:

1. A vacuum cleaner, comprising:

a motor configured to generate a suction force;

a battery;

an inverter configured to convert a direct current (DC) power of a DC terminal capacitor into an alternating current (AC) power, and to output the AC power to the motor; and a controller configured to:

apply a control signal of the inverter to drive the motor, detect an event while the motor is driving, and generate the control signal to generate an operation noise of the motor corresponding to the detected event, wherein the event includes a battery level corresponding to a first value or less, wherein the controller is further configured to generate the control signal to generate a first pattern of operation noise when the battery level corresponds to the first value or less, and wherein an average rotational speed of the motor, in an interval where the first pattern of operation noise is generated, is at least 90% of an average rotational speed of the motor in a specific interval before the event is detected.

2. The vacuum cleaner of claim 1, wherein the event further includes the battery level corresponding to a second value or less, the second value being smaller than the first value, wherein the controller is further configured to generate the control signal to generate a second pattern of operation noise when the battery level corresponds to the second value or less, and wherein the second pattern of operation noise has a longer duration than the first pattern of operation noise.

3. The vacuum cleaner of claim 1, wherein an average rotational torque of the motor, in the interval where the first pattern of operation noise is generated, is at least 90% of an average rotational torque of the motor in the specific interval before the event is detected.

4. The vacuum cleaner of claim 1, wherein within a time interval where the first pattern of operation noise is generated, the control signal has an interval where a low value is output between intervals where a high value is repeatedly output, and wherein two or more of the intervals where the low value is output are included in the time interval.

5. The vacuum cleaner of claim 1, further comprising a battery management system configured to manage the battery, wherein the controller is further configured to detect the event based on at least one of a first voltage obtained from the battery management system and a second voltage at the DC terminal capacitor.

6. The vacuum cleaner of claim 5, wherein the controller is further configured to:

generate the control signal to generate the first pattern of operation noise when the first voltage and the second voltage are within a specific voltage range, and output abnormal state information when at least one of the first voltage and the second voltage is not within the specific voltage range.

7. The vacuum cleaner of claim 1, wherein the event includes an inlet blockage event of the vacuum cleaner, and wherein the controller is further configured to detect the inlet blockage event based on a current value of the motor or a rotational speed of the motor.

8. The vacuum cleaner of claim 7, wherein the controller is configured to detect the inlet blockage event when the current value of the motor is below a preset current value, or wherein the controller is configured to detect the inlet blockage event when the rotational speed of the motor is above a preset speed value.

9. A control method of a vacuum cleaner, the control method comprising:

driving a motor to generate a suction force;

determining whether an event is detected; and controlling the motor to generate an operation noise of the motor corresponding to the detected event, wherein the event includes a battery level corresponding to a first value or less, wherein method further comprises controlling the motor to generate a first pattern of operation noise when the battery level corresponds to the first value or less, and wherein an average rotational speed of the motor, in an interval where the first pattern of operation noise is generated, is at least 90% of an average rotational speed of the motor in a specific interval before the event is detected.

10. The method of claim 9, wherein the event further includes the battery level corresponding to a second value or less, the second value being smaller than the first value, wherein method further comprises controlling the motor to generate a second pattern of operation noise when the battery level corresponds to the second value or less, and wherein the second pattern of operation noise has a longer duration than the first pattern of operation noise.

11. The method of claim 9, wherein an average rotational torque of the motor, in the interval where the first pattern of operation noise is generated, is at least 90% of an average rotational torque of the motor in the specific interval before the event is detected.

12. The method of claim 9, wherein within a time interval where the first pattern of operation noise is generated, a control signal sent to the motor has an interval where a low value is output between intervals where a high value is repeatedly output, and wherein two or more of the intervals where the low value is output are included in the time interval.

13. The method of claim 9, wherein the event is detected based on at least one of a first voltage obtained from a battery management system of the vacuum cleaner and a second voltage at a direct current (DC) terminal capacitor of the vacuum cleaner.

14. The method of claim 13, wherein controlling the motor comprises:

controlling the motor to generate the first pattern of operation noise when the first voltage and the second voltage are within a specific voltage range; and outputting abnormal state information when at least one of the first voltage and the second voltage is not within the specific voltage range.

15. The method of claim 9, wherein the event includes an inlet blockage event of the vacuum cleaner, and wherein the controlling the motor includes detecting the inlet blockage event based on a current value of the motor or a rotational speed of the motor.

16. The method of claim 15, wherein the inlet blockage event is detected when the current value of the motor is below a preset current value, or wherein the inlet blockage event is detected when the rotational speed of the motor is above a preset speed value.

* * * * *